US005328057A

United States Patent [19]

Hellenberg et al.

[11] Patent Number: 5,328,057

[45] Date of Patent: Jul. 12, 1994

[54] PAINT DISPENSER APPARATUS

[75] Inventors: Leendert Hellenberg, Warmond; Johannes H. Mink, Voorhout, both of Netherlands

[73] Assignee: Fluid Management Limited Partnership, Wheeling, Ill.

[21] Appl. No.: 36,416

[22] Filed: Mar. 25, 1993

[51] Int. Cl.[5] ..... B67D 5/52

[52] U.S. Cl. ..... 222/135; 222/144.5

[58] Field of Search ..... 222/135, 144.5, 145, 222/333; 141/100, 104

[56] References Cited

U.S. PATENT DOCUMENTS

| | | | |
|---|---|---|---|
| 2,654,505 | 10/1953 | Fuhrman | 222/2 |
| 2,787,402 | 4/1957 | Stiner et al. | 222/76 |
| 2,848,019 | 8/1958 | Corbin et al. | 141/100 |
| 2,865,614 | 12/1958 | Nagy | 222/144.5 |
| 3,349,962 | 10/1967 | Levin . | |
| 3,851,798 | 12/1974 | Miller | 222/135 |
| 4,046,287 | 9/1977 | Hoekstra et al. | 222/16 |
| 4,512,377 | 4/1985 | Greer | 222/135 |
| 4,705,083 | 11/1987 | Rossetti | 141/104 |
| 4,967,938 | 11/1990 | Hellenberg | 222/144.5 |
| 5,078,302 | 1/1992 | Hellenberg | 222/135 |
| 5,119,973 | 6/1992 | Miller et al. | 222/135 |

FOREIGN PATENT DOCUMENTS

| | | | |
|---|---|---|---|
| 0283137B1 | 4/1992 | European Pat. Off. | B05B 1/32 |

OTHER PUBLICATIONS

"The Colour Philosophy," 16 page Trade Brochure of (manufacturer) COROB (no date available).

"*Miller* Accutinter® 4000 Colorant Dispenser," 1 page, 2-sided Brochure RA9114/ACC4000, Printed in USA, Miller Manufacturing® A Division of *Fluid Management* Limited Partnership, Addison, Ill. (No date shown on brochure).

"*Miller* Accutinter® 600 Fluid Dispenser," 1 page, 2-sided Brochure RA90108/ACC600, Printed in USA, Miller Manufacturing® A Division of *Fluid Management* Limited Partnership, Addison, Ill. (No date shown on brochure).

"The Eurotinter: A Powerful and Well Researched Concept.," 1 page brochure, Ateliers Sussmeyer S. A., Bruxelles (No date shown on brochure).

"Eurotinter E-12-AS and E-16-AS—An Avalance of Possibilities.," 1 page brochure, Ateliers Sussmeyer S. A., Bruxells (No date shown on brochure).

"E. T. Junior: Low Investment for Tinting Paints and Varnishes for Retail Distribution.," 1 page brochure, Ateliers Sussmeyer S. A., Bruxelles (No date shown on brochure).

"From Retail Shop to In-Plant Production Unit—The Eurotinter.," 1 page brochure, Ateliers Sussmeyer S. A., Bruxelles (No date shown on brochure).

*Primary Examiner*—Andres Kashnikow
*Assistant Examiner*—Philippe Derakshani
*Attorney, Agent, or Firm*—Fitch, Even, Tabin & Flannery

[57] ABSTRACT

Dispensing apparatus is provided with motor driven pumps and their drive motors mounted on modular skids which are easily removed for servicing or upgrade. An improved dispense head arrangement is provided with dispense valves located close to a common dispense head. The dispensing apparatus may also be readily reconfigured for use with remotely located tanks in which materials to be dispensed are stored.

14 Claims, 7 Drawing Sheets

PAINT DISPENSER APPARATUS

BACKGROUND OF THE INVENTION

1. Field of the Invention
2. Description of the Related Art

The assignee of the present invention has developed a number of important and commercially successful automatic and semi-automatic machines for dispensing liquid and pulverulent materials. Examples of these machines are given in commonly assigned U.S. Pat. Nos. 3,851,798; 4,813,785; 4,953,985; 4,967,938; 5,078,302 and 5,119,973. These machines typically include one or more storage canisters for holding material to be dispensed, and arrangements of valves and pumps for delivering the stored material to a dispense head. The dispense head may either be individual for each canister or may be shared among several canisters, having individual fluid paths located within a common dispense head. Improvements have been sought in improving the economy of manufacture of these machines, and to make the machines more readily adaptable as a customer's needs for dispensing apparatus changes.

SUMMARY OF THE INVENTION

It is an object according to principles of the present invention to provide apparatus for dispensing liquid and pulverulent materials.

Another object according to principles of the present invention is to provide dispensing apparatus which accommodates on-board storage of canisters containing material to be dispensed.

It is another object according to principles of the present invention to provide dispensing apparatus which provides quick and easy servicing of internal components as well as a rapid upgrading of existing components.

A further object according to principles of the present invention is to provide dispensing apparatus which is readily converted to accept external storage tanks.

These and other objects according to principles of the present invention which become apparent from subbing the appended description and drawings are provided in apparatus for dispensing material into a container, comprising:

a housing;

a plurality of material storage containers in said housing;

a plurality of pumps coupled to respective ones of said material storage containers;

at least one motor for driving said pumps;

dispense valves in said housing for controlling a flow of material therethrough in response to user-defined control commands;

a dispense head for directing material into the container;

a plurality of conduit means coupling said pump means to said dispense valves and coupling said dispense valves to said dispense head;

control means for generating control commands in response to user-defined control commands, located in said housing and coupled to said dispense valves so as to control the flow of material through the dispense head and into the container;

said at least one motor and said plurality of pumps mounted on a common skid; and means for removably mounting the skid to the housing.

DETAILED DESCRIPTION OF THE PREFERRED EMBODIMENT

Figure 1:
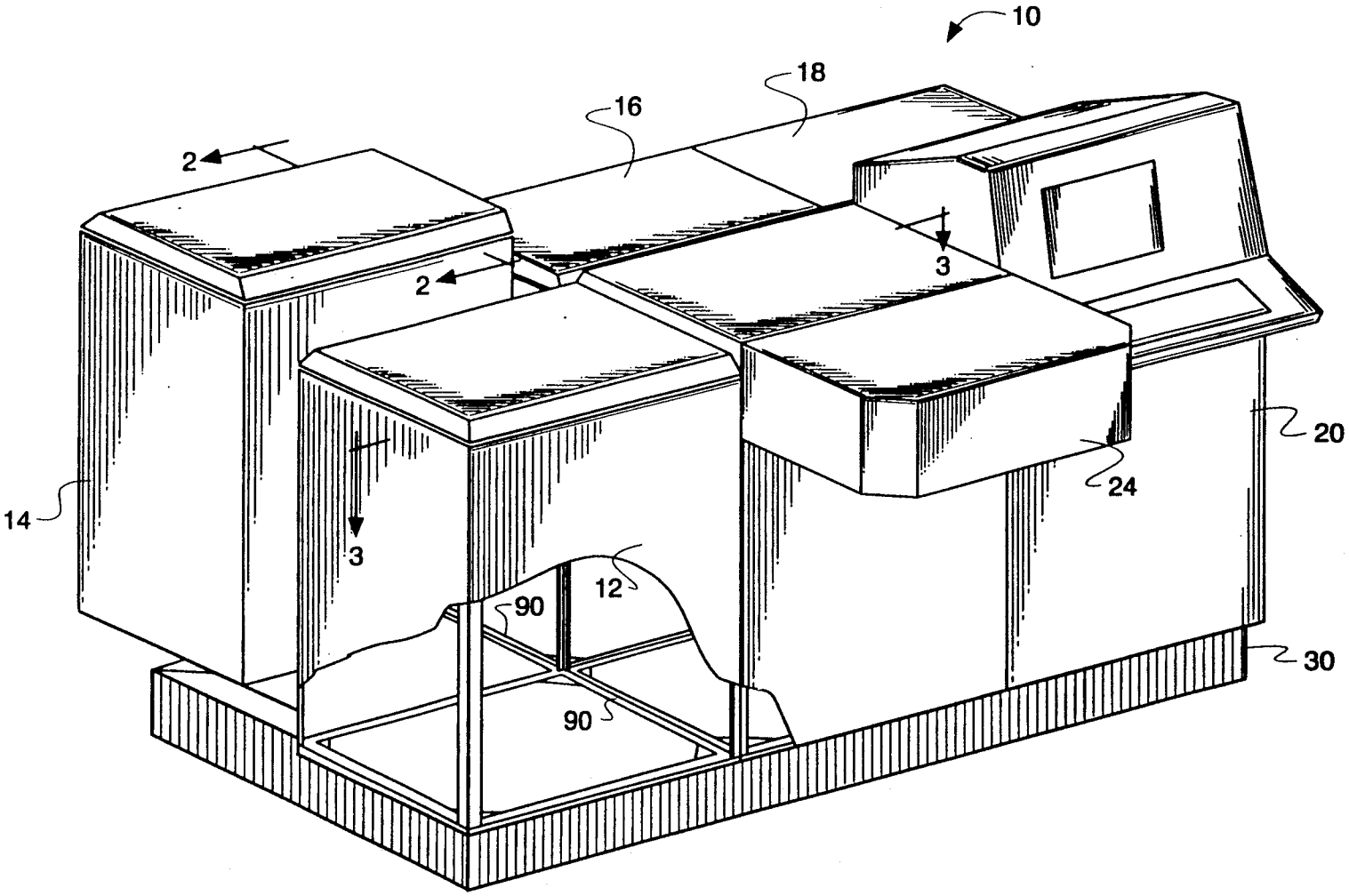
FIG. 1 is a perspective view of dispensing apparatus according to principles of the present invention.
Figure 2:
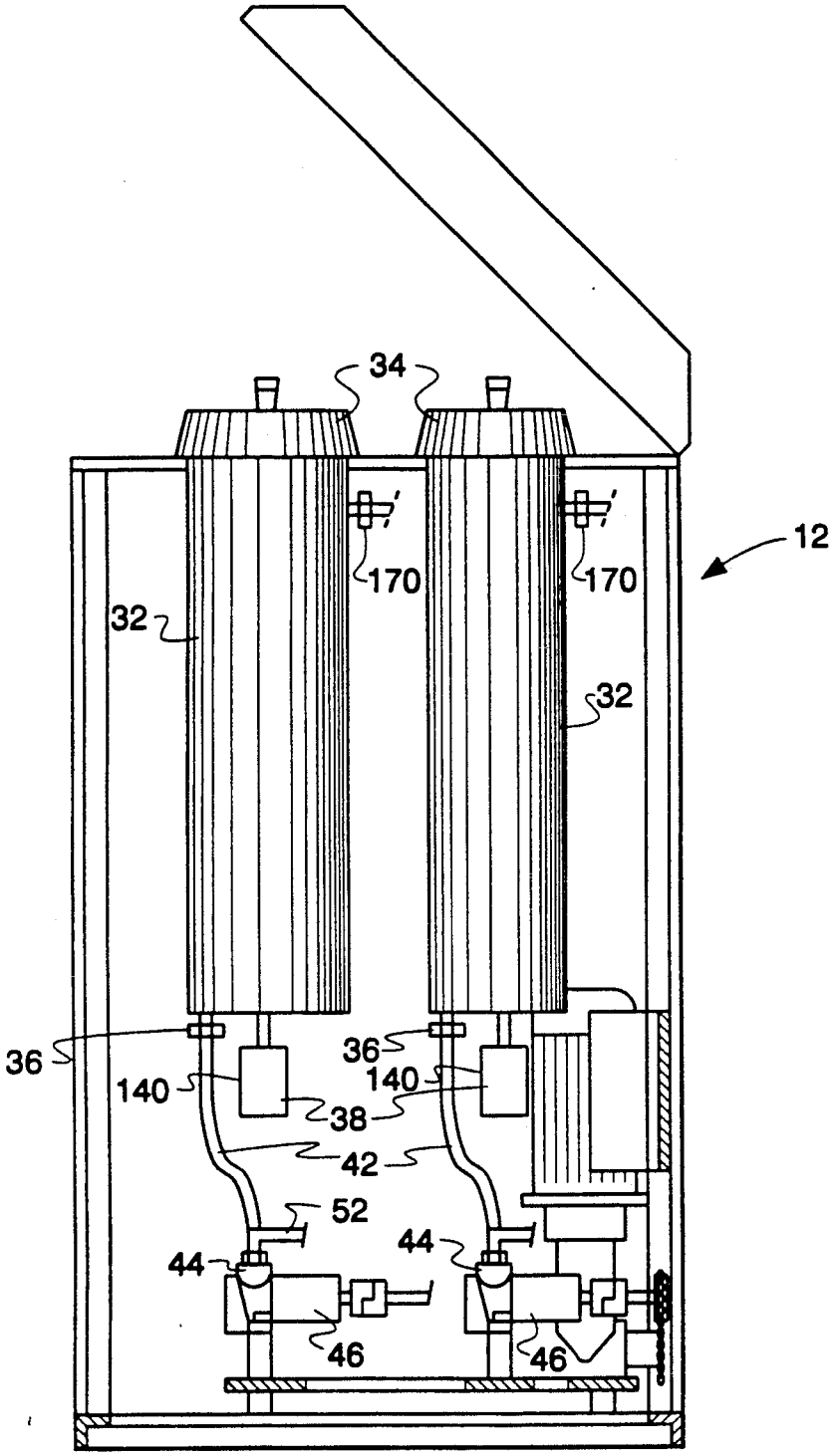
FIG. 2 is a fragmentary cross-sectional view taken along line 2—2 of FIG. 1.
Figure 3:
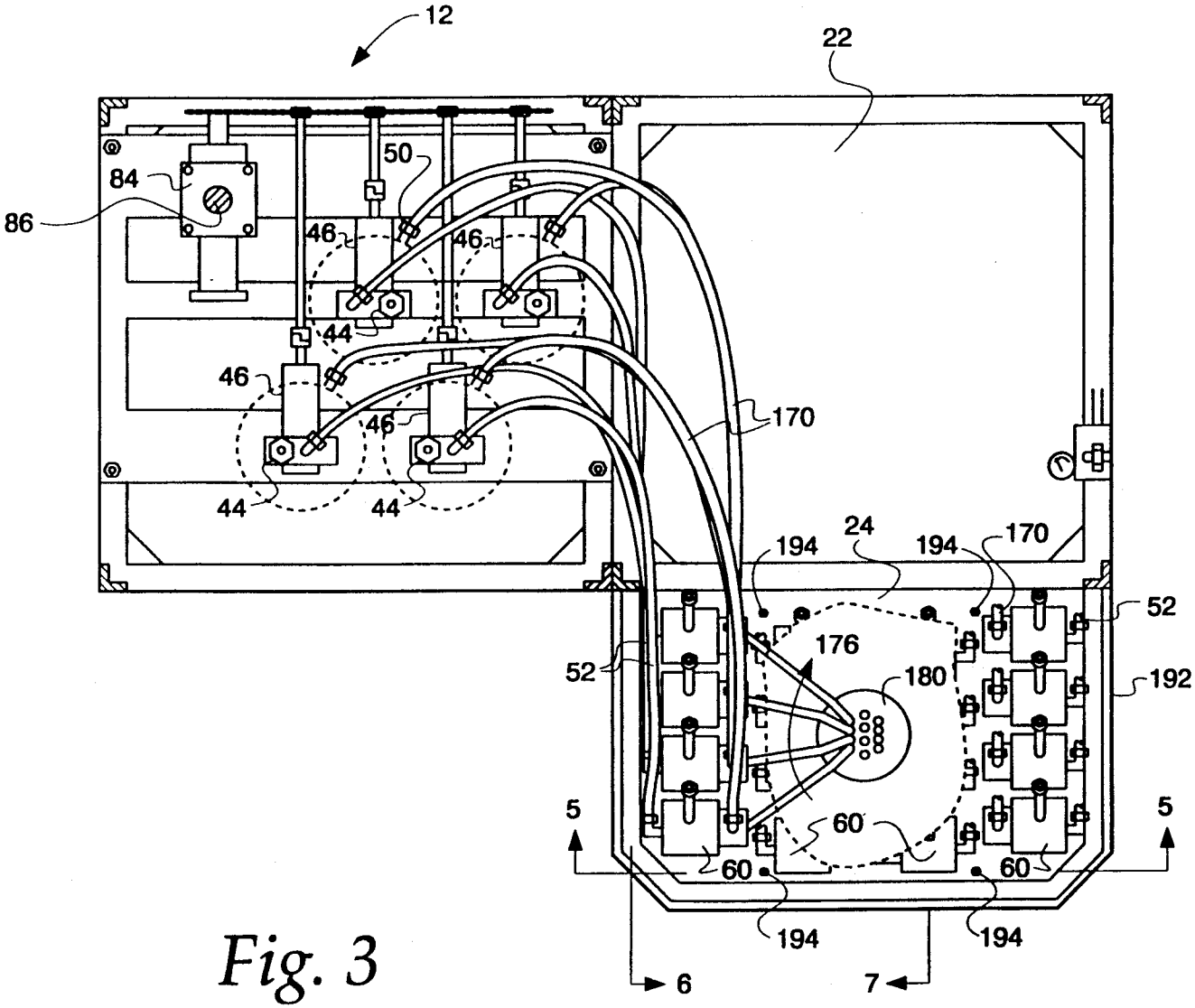
FIG. 3 is a fragmentary cross-sectional view taken along the line 3—3 of FIG. 1.

Referring now to the drawings, dispensing apparatus, generally indicated at 10, is shown in FIG. 1. The dispensing apparatus is preferably comprised of six modules 12–22, and a dispense hood 24, cantilevered from module 22. The modules are preferably mounted on a common base 30. As will be seen herein, modules 12–18 are preferably identical to one another, and module 20 includes control circuitry. Module 22 encloses conduits connected to a dispense head located within the dispense hood 24. If desired, the modules 12–18 can be omitted, or they can be replaced with modules of different configurations, or if necessary additional modules can be added. An important feature of apparatus according to principles of the present invention, is that the control circuits and dispense head located in modules 20–24 can be adapted for use with a wide variety of equipment, the modules being quickly and easily reassembled in virtually any configuration desired. Referring additionally to FIGS. 2 and 3, in the preferred embodiment, modules 12–18 contain motor-driven pumping equipment, and most preferably contain storage canisters, in addition thereto. For example, referring to FIG. 2, four storage canisters are located in the upper portion of module 12. As can be seen in FIG. 2, and as indicated in the breakaway portion of FIG. 1, the modules are preferably constructed of an open framework of hollow tubing, angle iron or the like members, with sides being covered with a sheet metal "skin". The canisters 32 include removable covers 34 through which material is poured to fill the containers. Each canister 32 has an outlet 36 and optionally includes a stirring motor 38 so as to stir contents within the canisters. Conduits, preferably in the form of flexible hoses 42, connect the canister outlets 36 with inlets 44 of pumps 46. Outlets 50 of the pumps are coupled by conduits 52 to dispense valves 60.

Figure 8:
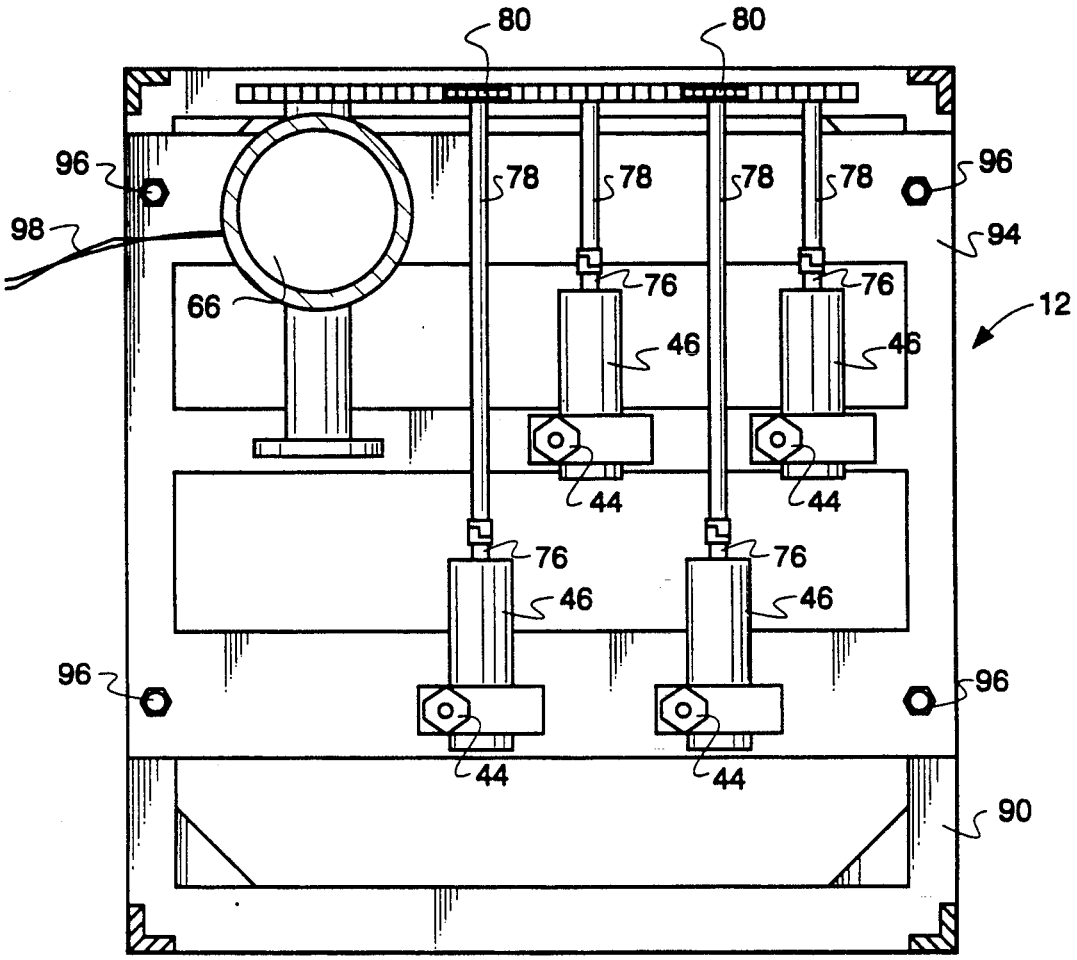
FIG. 8 shows the left-hand portion of FIG. 3 on an enlarged scale.
Figure 9:
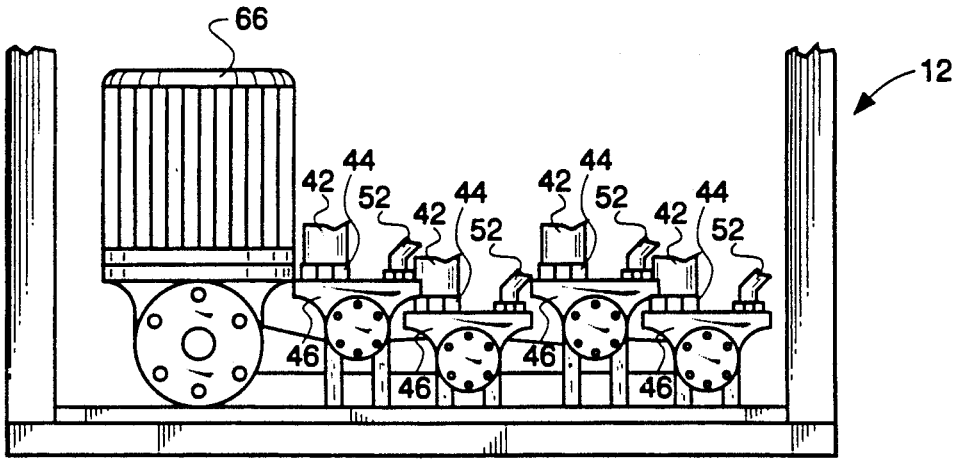
FIG. 9 is a fragmentary front elevational view thereof.
Figure 10:
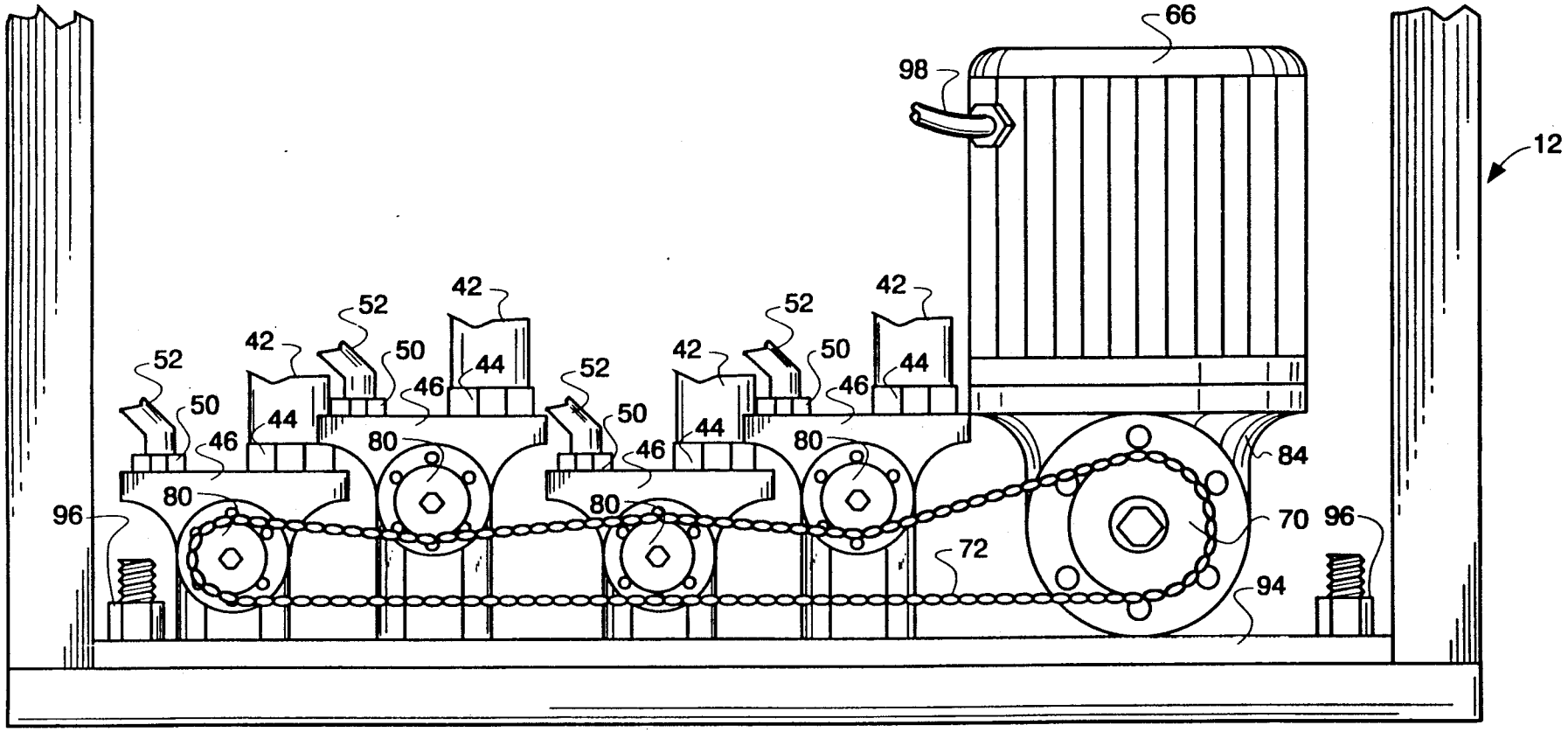
FIG. 10 is a fragmentary rear elevational view thereof on an enlarged scale.

As can be seen in FIG. 10, for example, a single motor 66 simultaneously drives four pump modules. Motor 66 has an output shaft 68 with a gear 70 which drives a chain 72. With reference to FIG. 8, the pumps 46 have respective operating shafts 76 coupled to intermediate shafts 78 of varying length. In the preferred embodiment, two different lengths of intermediate shafts 78 are employed, as can be seen in FIG. 8, for example. The intermediate shafts 78 are connected to gears 80 which mesh with chain 72, thus completing the driving linkage for the individual pumps. In the preferred embodiment, the motor 66 is coupled to output shaft 68 through a gear box 84. FIG. 3 is cut away to show the output shaft 86 of the motor, as it enters the gear box 84.

Referring again to FIG. 8, the framework of module 12 has a bottom, generally rectangular end 90. The motor 66 and pumps 46 are mounted on a common mounting base or skid 94 secured to the bottom end 90 of the framework with threaded fasteners 96. Thus, by removing the threaded fasteners 96, the inlet and outlet connections to the pumps, and the electrical connection via conductors 98 with motor 66, the skid 94 and the related motor, pump and transmission equipment can be quickly and easily removed to a remote location for servicing, upgrade or replacement. The modules 12–18 are preferably identical to one another, both with regard to the skids 94, their related equipment, the open metal framework and metal skins. The conductors 98 of the various motors associated with each respective skid are brought to the control module 20 for coupling with control circuitry housed therein. As shown in FIG. 3, the outlet conduits 52 from each pump pass through module 22 for connection to valves on the dispensing tray located in dispensing hood 24.

As can be seen in FIG. 10, for example, the intermediate shafts driving the various pumps are arranged generally coplanar with one another in side-by-side relationship.

Figure 4:
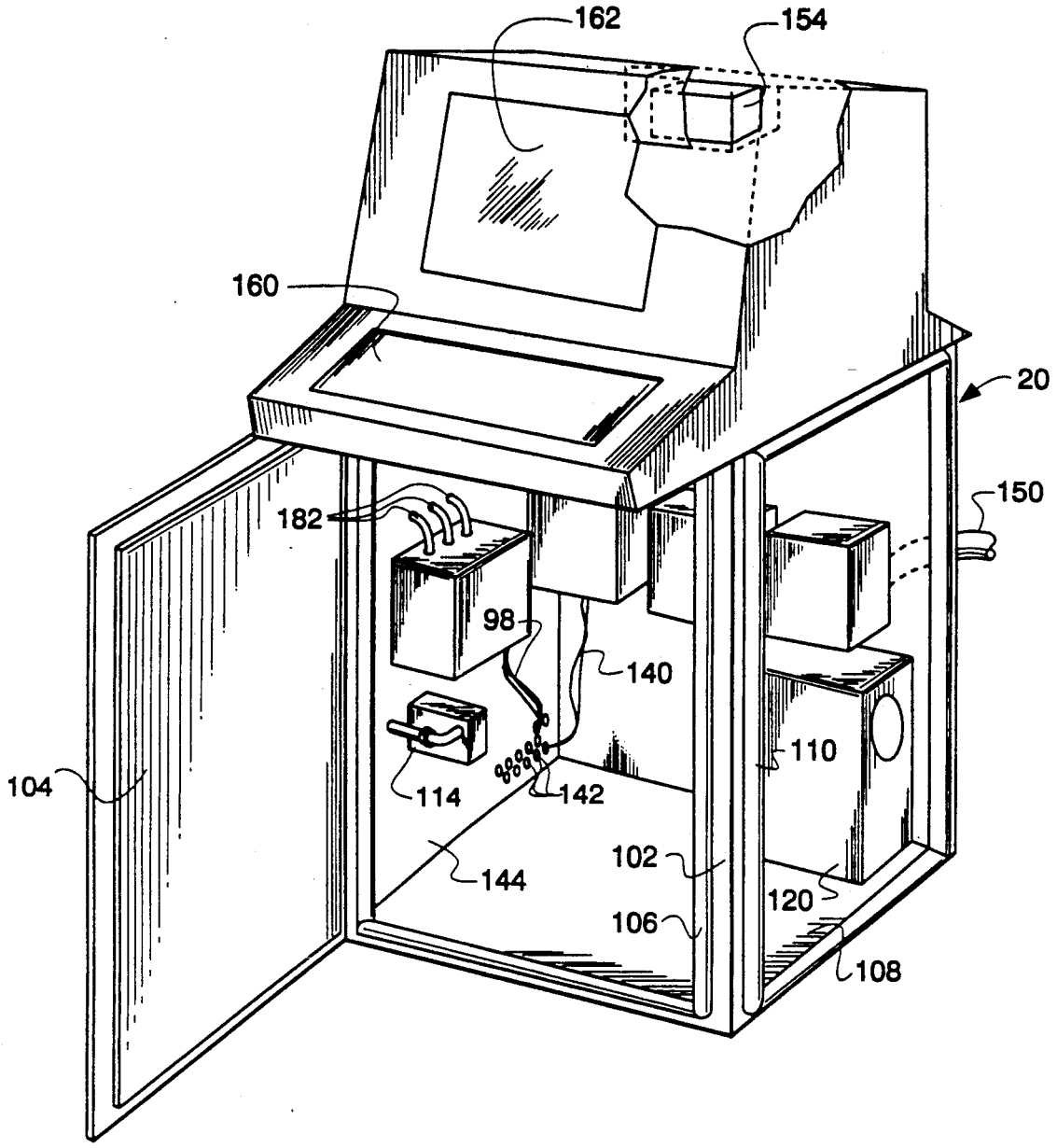
FIG. 4 is a fragmentary perspective view showing the front right corner module of the apparatus of FIG. 1.

Referring now to FIG. 4, the module 20 is preferably constructed with an open framework 102, the sides and top and bottom faces thereof being covered with sheet metal panels. For example, the front face of framework 102 is covered with a sheet metal door 104, which is sealed with a gasket 106. As shown in FIG. 4, an opening 108 is formed for ready service of the components disposed within the module. A gasket 110 seals the sheet metal wall which seals the opening 108. According to one aspect of the present invention, the module 20 is pressure-tight and is preferably designed so as to accommodate an elevated pressure, above ambient. An air-purging system and over-pressure control is employed in the preferred embodiment. Included is a Model No. SE-001, EEx-p control unit commercially available from the Didex Corporation. A source of pressurized air 114 enters module 20, and flow of the air into module 20 is controlled by the flow control unit 120.

According to one aspect of the present invention, the module 20 is pressure-tight, suitable for maintaining an elevated pressure therein so as to prevent materials being dispensed and other foreign matter from entering the chamber interior. This provides a "safe zone" for the electronic and the electrical equipment disposed within the chamber, free from interaction with the outside environment surrounding other portions of the dispenser apparatus. Disposed with a module 20 is a variety of electronic and electrical control equipment which, as mentioned above, controls operation of the pump motors, and which receives and processes valve rotation information through conductors in cable 98. Equipment within module 20 also controls the stirring motors to maintain materials in the canisters 32 in suspension. In the preferred embodiment, conductors 110 are coupled to control equipment within module 20, passing through pressure-tight sealing glands 112 mounted in sheet metal wall 144 separating module 20 from the neighboring module 22.

Referring to FIG. 4, module 20 receives a conduit 150 coupled to an external source of air pressure or a pressurized, relatively inert gas. Air flow through the conduit 150 enters module 20, pressurizing the module under the control of the environmental control unit 120. The module is allowed to fill with pressurized air, and is released by a secondary control module, Model SE-003, also available from Didex Corporation. The secondary module is indicated by the reference numeral 154, and is coupled to the control module 120 by conductors within module 20 (not shown). In the preferred embodiment, module 20 is repressurized and air is discharged by secondary module 154, thus completing multiple air changes within module 20. Thereafter, during operation of the dispensing apparatus, control unit 120 maintains a specified overpressure within module 20, with a continuous air flow passing through the module, and exiting the secondary module 154.

Turning now to FIGS. 2 and 3, the present invention has found immediate commercial acceptance in the field of coatings dispensing. For example, the dispenser apparatus is suited for dispensing tinting materials into a receptacle containing a paint base. Optionally, the dispensing apparatus according to principles of the present invention can also be readily adapted to dispense paint base material into an empty container, as well. An operator would fill the canisters 32 with a tinting material.

Referring to FIG. 4, the operator would query a digital computer with a module 20, via the keyboard 160 and the CRT monitor 162. After having selected the desired formulation, the digital computer within module 20 would identify the colorant canisters which are needed to contribute to the formulation, and the amount of colorant to be discussed. The respective pump motors would then be energized in preparation for a dispense operation, charging the pump discharge line 52 with a dispensing pressure. Material from the canisters 32 would enter the pump through conduits 42. A flow of material would be initiated through dispense valve 60, returning to the canisters 32 through return lines 170 (see FIGS. 2 and 3).

Figure 5:
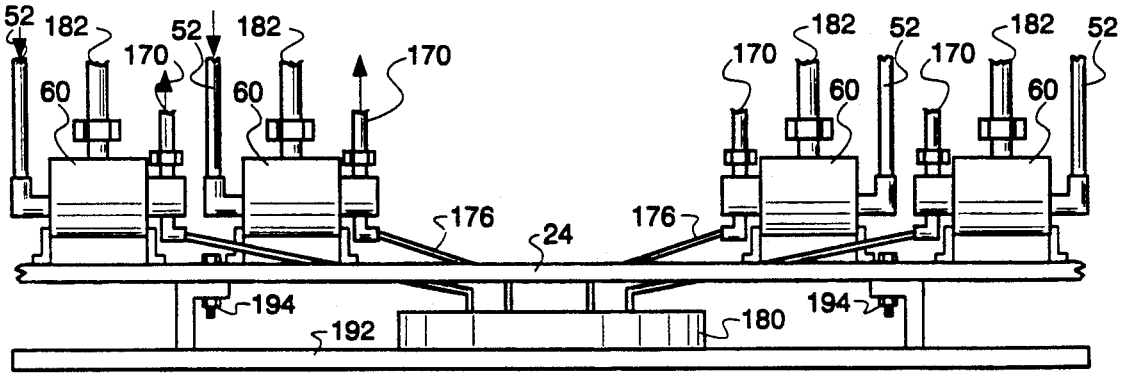
FIG. 5 is a fragmentary front elevational view shown partly in cross section, taken along the line 5—5 of FIG. 3.
Figure 6:
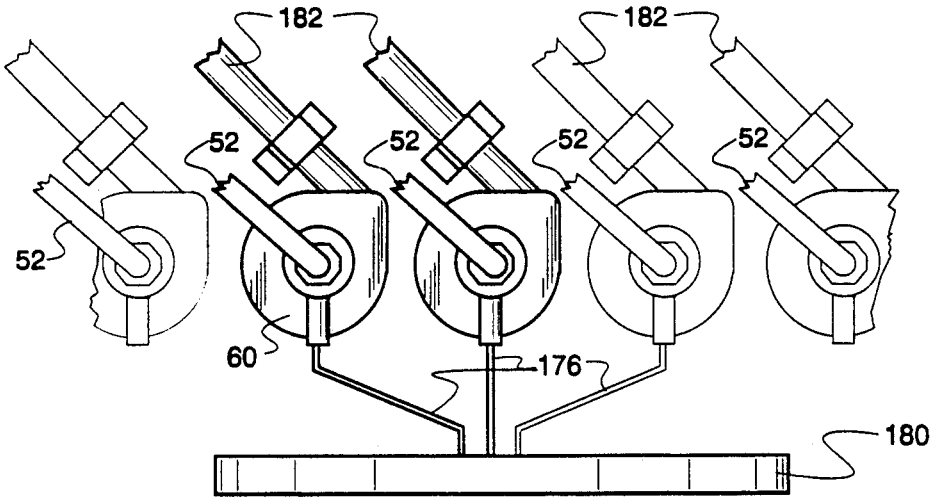
FIG. 6 is a fragmentary side elevational view of the dispensing tray, taken from the left side thereof.
Figure 7:
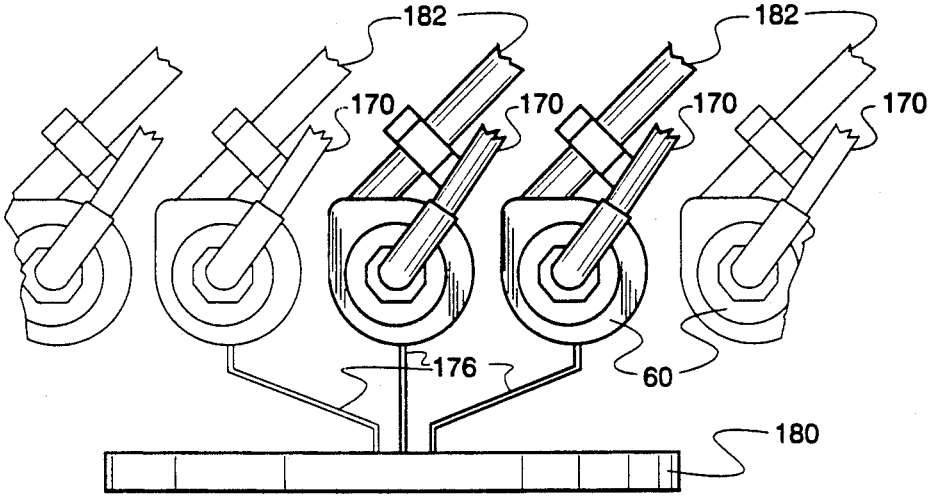
FIG. 7 is a fragmentary side elevational view of the dispensing tray, taken from the right side thereof.

Referring additionally to FIGS. 5–7, the dispense valves 60 include metering output lines 176 which terminate in a dispense head 180. The dispense valves 60 are preferably operated by electrical control signals which travel through conductors 182 which are coupled between the discharge valve 60 and the control equipment located within module 20. As mentioned, the digital microcomputer control in module 20 receives pump rotation information which provides at least an indirect indication of the volume of materials passing through the dispense valves 60. The computer control, via conductors 182, triggers an opening of dispense valve 60 for a defined period of time, so as to accurately dispense a controlled amount of material in metering lines 176. When the desired amount of material has been dispensed, the control equipment in module 20 signals a closing of the dispense valve, with material flow circulating through the dispense valves, returning to canisters 32 via return lines 170.

According to another aspect of the present invention, the dispense valves 60 are conveniently mounted on a common tray 24, which is removably mounted to supporting framework 192 by releasable fasteners 194. Accordingly, by disconnecting the conduits 52, 170 and 176 from the respective dispensing valves 60, the dispensing tray 24 with the dispensing valves can be removed to a remote site, such as a workbench, for servicing for modifications. As indicated in FIG. 5, the individual dispensing valves 60 are mounted to tray 24, preferably with removable securements, such as screw fasteners. If desired, the individual dispensing valves can be removed from the tray 24 for individual servicing or replacement, with the remainder of the tray being left in place.

The dispensing apparatus according to principles of the present invention provides heretofore unavailable flexibility providing significant advantages in a wide variety of different applications. For example, on-board storage canisters have been illustrated in the preferred embodiment. However, it is possible to omit the modules 12–18, altogether, and to provide material under pressure through flexible conduits, such as nylon hosing and the like. One example of a pressurized source is given in commonly assigned [U.S. patent application Ser. No. 08/036,671, filed concurrently herewith]. Control equipment within a module 20 would be coupled through suitable electrical conductors to the pump motors and shaft encoders of the external pumping module.

As another alternative, additional modules, similar to the modules 12–18, can be employed in addition to the four modules shown in FIG. 1. For example, if additional materials are to be dispensed, additional modules can be grouped around the arrangement of FIG. 1, or can be stacked on top of any of the modules 12–18 and 22 shown in FIG. 1. As mentioned, it is generally preferred that the outer sheet metal "skin" of the modules be quickly and easily movable so that the inner steel framework 90 of the various modules can be connected directly together.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for dispensing material into a container, comprising:

a housing;

a plurality of material storage containers in said housing;

a plurality of pumps coupled to respective ones of said material storage containers;

at least one motor for driving said pumps;

dispense valves in said housing for controlling a flow of material therethrough in response to user-defined control commands;

a dispense head for directing material into the container;

a plurality of conduit means coupling said pump means to said dispense valves and coupling said dispense valves to said dispense head;

control means for generating control commands in response to user-defined control commands, located in said housing and coupled to said dispense valves so as to control the flow of material through the dispense head and into the container;

said at least one motor and said plurality of pumps mounted on a common skid; and means for removably mounting the skid to the housing.

2. The apparatus of claim 1 further including a hood cantilevered from said housing, with said dispense head and dispensing valves located within said hood so as to overhang a container being filled.

3. The apparatus of claim 1 wherein the skid carries four pumps and one motor, along with transmission means coupling the motor to the pumps for driving engagement therewith.

4. The apparatus of claim 3 wherein the transmission means comprises four drive shafts, each coupling a respective pump to a respective gear, and a chain driven by said motor and coupled to said gears, so that said motor simultaneously drives said pumps.

5. The apparatus of claim 4 wherein each pump associated with a common skid is driven by a respective drive shaft, the drive shafts, the drive shafts arranged generally coplanar with one another.

6. The apparatus of claim 1 further comprising a plurality of skids so as to accommodate a larger number of different materials for dispensing in said dispense head.

7. The apparatus of claim 1 wherein the housing further defines a pressurized compartment for enclosing the control means.

8. The apparatus of claim 1 wherein the dispensing valves include housings for containing high pressures, substantially higher than those associated with dispensing operations.

9. The apparatus of claim 1 wherein the dispensing valves further include outputs for directing a flow of material through the dispensing valves, with the conduit means coupling the outputs of said dispensing valves to the storage containers.

10. The apparatus of claim 1 wherein said transmission means comprises four drive shafts, each coupling a respective pump to a respective gear, and a chain driven by said motor and coupled to said gears, so that said motor simultaneously drives said pumps.

11. Apparatus for dispensing material into a container, comprising:

a housing;

receptacle means for receiving a flow of material from a pressurized source of material;

dispense valves in said housing for controlling a flow of material therethrough in response to user-defined control commands;

a dispense head for directing material into the container;

a plurality of conduit means coupling said receptacle means to said dispense valves and coupling said dispense valves to said dispense head;

control means for generating control commands in response to user-defined control commands, located in said housing and coupled to said dispense valves so as to control the flow of material through the dispense head and into the container; and said dispense valves removably mounted in an array on a mounting tray, the mounting tray removably mounted within said housing, immediately adjacent said dispense head.

12. The apparatus of claim 11 further including a hood cantilevered from said housing, with said dispense head located substantially entirely within said hood so as to overhang a container being filled.

13. The apparatus of claim 11 wherein both said dispense head and said mounting tray located substantially entirely within said hood.

14. The apparatus of claim 11 further comprising a second mounting tray with said one tray disposed between said dispense head and said second mounting tray.

* * * * *